US005785612A

United States Patent [19]

Shapiro et al.

[11] Patent Number: 5,785,612

[45] Date of Patent: Jul. 28, 1998

[54] GOLF BALL

[75] Inventors: Neil A. Shapiro, Jackson; Marc E. Welch; Dwaine Phillips, both of Humboldt, all of Tenn.

[73] Assignee: Wilson Sporting Goods Co., Chicago, Ill.

[21] Appl. No.: 632,891

[22] Filed: Apr. 16, 1996

[51] Int. Cl.[6] ..... A63B 37/14

[52] U.S. Cl. ..... 473/377; 473/378; 40/327

[58] Field of Search ..... 40/327; 473/378, 473/373, 374, 377

[56] References Cited

U.S. PATENT DOCUMENTS

| | | |
|---|---|---|
| 4,679,794 | 7/1987 | Yamada . |
| 4,679,795 | 7/1987 | Melvin . |
| 4,798,386 | 1/1989 | Berard . |
| 4,802,674 | 2/1989 | Kitaoh . |
| 4,865,326 | 9/1989 | Isaac . |
| 5,000,458 | 3/1991 | Proudfit . |
| 5,018,742 | 5/1991 | Isaac . |
| 5,029,870 | 7/1991 | Concepcion . |
| 5,156,405 | 10/1992 | Kitaoh . |
| 5,160,536 | 11/1992 | Harris . |
| 5,200,438 | 4/1993 | Fujii . |
| 5,300,325 | 4/1994 | Nealon . |
| 5,409,233 | 4/1995 | Kennedy . |
| 5,461,109 | 10/1995 | Blair . |
| 5,542,680 | 8/1996 | Proudfit et al. ..... 40/327 |

FOREIGN PATENT DOCUMENTS

| | | |
|---|---|---|
| 60-109657 | 8/1985 | Japan . |
| 61-16885 | 10/1986 | Japan . |

*Primary Examiner*—George J. Marlo

[57] ABSTRACT

A golf ball consisting of a core, a cover, and a single coat of solvent-based transparent paint in contact with the cover, the coat of paint being the outermost coat of the golf ball and including an optical brightener, and indicia on the single coat of paint, the indicia comprising UV cured ink, which is chemically bonded to the coat of paint, the indicia being free of any protective coating.

1 Claim, 1 Drawing Sheet

GOLF BALL

BACKGROUND

This invention relates to golf balls, and, more particularly, to a golf ball which includes only one coat of paint and a stamp of UV cured ink.

Golf balls conventionally include a core and a cover. The core can be a one-piece solid core or a two-piece core which includes a liquid or solid center and a layer of elastic windings. The cover can be formed from natural or synthetic balata or from synthetic polymeric material such as urethane or ionomeric resins such as Surlyn, which is an ionic copolymer resin available from E. I. DuPont de Nemours & Co., and Iotek, which is an ionic copolymer resin available from Exxon.

Historically, golf balls were finished with two or more coats of white opaque paint, which provided the balls with the desired white color. The first coat of paint is a primer coat, which is applied to provide adhesion to the cover. The primer coat is covered with one or more additional coats of white paint, and one or more clear coats of urethane or epoxy are applied as finish coats.

U.S. Pat. No. 4,679,795 describes incorporating white pigment and an optical brightener in the cover and eliminating the coats of white paint.

Japanese Utility Model Application No. 60-109647 describes a golf ball having a cover which is formed from ionomer resin and which contains a white pigment. The golf ball is coated with a clear paint in which a fluorescent brightener is mixed. Although the application does not specifically describe applying two coats of paint, we believe that the cover was first coated with a layer of primer paint in order to increase the adhesion between the surface of the ionomer resin and the coating of paint with the optical brightener.

A few small manufacturers of golf balls make golf balls which have one coat of UV curable paint applied directly to the cover. The performance of these balls do not meet our standards for acceptable golf balls, and these balls are not commercially significant.

U.S. Pat. No. 5,461,109 describes a water-reducible golf ball coating which can be applied to a Surlyn covered golf ball without a primer coat or an adhesion promoting layer. The coating is formed from two components, and one of the components contains an optical brightener.

U.S. Pat. Nos. 4,865,326 and 5,018,742 describe incorporating optical brightener in the outermost clear coat of a golf ball. All of the balls described in the examples are coated with a first clear polyurethane primer coat and a second or finish clear coat. If optical brightener is used, it is incorporated in the outermost coat. Example VI describes stamping a trademark or other indicia on the ball after the primer coat was applied, and then applying the outermost clear coat. The second paragraph in column 1 explains that stampings are by their nature non-durable, and prior art golf balls typically had one or two clear coats applied over the stampings to protect the stampings.

U.S. Pat. No. 5,000,458 describes incorporating optical brightener in the primer coat and then applying an outermost clear coat or finish coat which does not contain optical brighteners.

SUMMARY OF THE INVENTION

We have discovered that substantial savings can be achieved by applying only one coat of clear paint to the cover of a golf ball. The paint is a fast drying solvent-based paint which includes an optimum amount of optical brightener. The single coat of clear paint combines the features of the two coats which were previously used—it enhances the white color of the ball through the optical brightener, and it provides good cosmetic appearance. Substantially less optical brightener is required when only one coat is used, and the single coat can be applied by an automatic paint spray line, thereby eliminating manual handling of the balls.

If conventional stamping is used, the stamps are applied to the cover before the single coat of paint. Preferably, the stamping uses a durable UV curable ink which is cured by ultraviolet light. The UV curable ink can be applied either directly to the cover or on top of the single coat of paint. The UV cured ink is durable enough that a protective coat over the stamp is not required.

The UV curable ink can also be used to apply stamps to conventional golf balls which include two or more clear or opaque coats. The stamp can be applied directly to the cover, on top of the primer coat, or on top of the outermost or finish coat.

DESCRIPTION OF THE DRAWINGS

The invention will be explained in conjunction with an illustrative embodiment shown in the accompanying drawing, in which.

DESCRIPTION OF SPECIFIC EMBODIMENT

Figure 1:
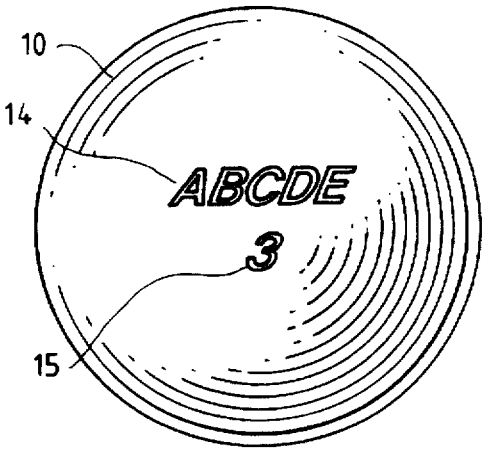
FIG. 1 illustrates a golf ball which is made in accordance with the invention.
Figure 2:
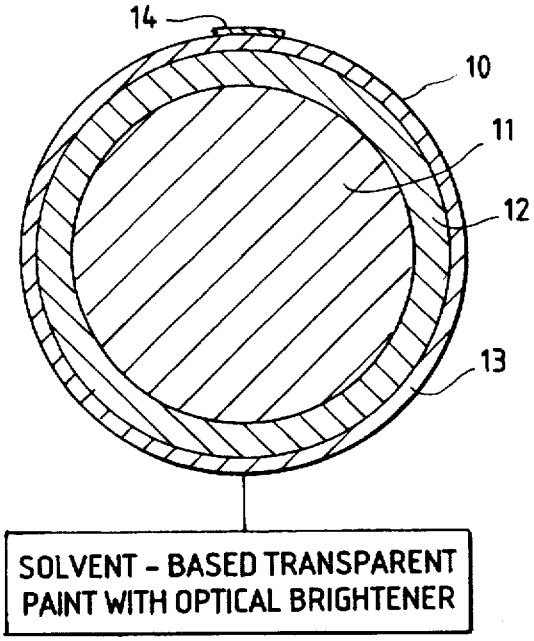
FIG. 2 is a sectional view of the golf ball.

Referring to the drawing, a golf ball 10 includes a core 11 and a cover 12. The cover is coated with a single coat 13 of transparent or clear paint. A logo or trademark 14 and an identifying number 15 or other indicia are stamped onto the coat 13.

The core 11 can be conventional, for example, a solid molded core or a two-piece wound core which consists of a solid or liquid-filled center and a layer of elastic windings.

The cover 12 can be formed from natural or synthetic balata or ionomer resins such as Surlyn and Iotek resins.

Such cores or covers are well known in the art, and a detailed description thereof is unnecessary.

The cover can be injection molded about the core or can be formed from two hemispherical half shells which are compression molded about the core. Suitable dimples are molded into the cover during the molding operation.

The cover includes a white pigment such as $TiO_2$ or ZnO and preferably also includes a blue pigment or bluing agent such as Ultramarine Blue. The white pigment can consist of about 0.50 to 10.0% by weight of the cover, and the blue pigment can consist of about 0.002 to 0.05% by weight of the cover. The polymeric material can consist of about 90.0 to 99.0% by weight of the cover.

The single coat 13 of paint is a faster-drying paint which includes an optical brightener. The preferred paint is a solvent-based two component urethane paint which is available from Dexter Corp. of Waukegan, Ill. The two components are designated 7000A70M and 0300A62M. The paint has a solids content of about 38% by weight, but the solids content can range from 35 to 45% by weight. The preferred paint does not contain water, but water-based paints could also be used.

Optical brightener is preferably added at a level of about 0.2% by weight of the solids content of the paint. The optical brightener can be added at a level within a range of about 0.05 to 0.25% of the solids content of the paint.

An optical brightener is a material which absorbs light in the ultraviolet range and emits in the blue range of visible light. Optical brighteners for use in the cover or clear coats of golf balls are well known. U.S. Pat. Nos. 5,000,458, 5,018,742, and 4,679,795 describe suitable optical brighteners.

Golf ball covers which are formed from Surlyn resins or other ionomer resins have relatively low adhesion. The low adhesion generally requires the cover to be coated with a primer coat before the finish coat is applied. It is believed that the aforementioned paint from Dexter Corp. ingludes an additive to promote adhesion to the cover. However, we do not know the nature of the additive or the exact formulation of the paint.

The logo 14 and identifying number 15 can be stamped by a conventional pad printing process which transfers ink from a cliche, or image carrier, to the ball by a flexible pad. The pad is conventionally silicone. Conventional stamping ink is thermoplastic in nature and is air dried. If conventional stamping ink is used, the logo and identifying number are preferably stamped directly onto the cover before the paint coat 13 is applied so that the stampings are protected by the layer of paint.

The preferred embodiment of the invention uses a durable ultraviolet (UV) curable ink. The UV ink contains photoiniators and acrylates from which their curing properties are derived. Acrylates are also referred to on material safety data sheets of ink suppliers as acrylated epoxy oligomers and acrylated monomers. Pigments may also be included to achieve various colors. UV curable inks are well known in the printing ink business, but the formulations of the inks are not published by the manufacturers. The UV curable ink used in the preferred embodiment was obtained from Trans Tech America, Inc. of Carol Stream, Illinois under the designation UVA Pad Printable Ink.

The UV curing process involves exposing the ink to high intensity UV light to initiate curing. UV curing can be done in-line, with curing equipment mounted on the ball conveying system of the pad printer, or off-line, by placing the balls in trays and conveying them through a remote lamp housing or tunnel by a feed belt.

The UV curing chemically bonds the ink to the cover or to the coat of paint. The ink is dry to the touch immediately after curing and the ball can be handled at that time without damaging the stampings.

The UV curable ink can be printed onto the outer paint coating, and no protective coating is required. The cured ink chemically bonds to the paint and is so durable that a protective coating is unnecessary.

The preferred golf ball includes a single coat of paint and UV cured ink stampings on the outside of the paint coat. However, the UV curable ink can also be used with conventionally painted balls which include a prime coat and one or more additional coats. The UV cured ink is durable enough to be stamped on the outermost coat, but it can also be stamped on the cover, on the primer coat, the first finish coat, etc.

Golf balls which are prepared with a single coat of paint and/or UV curable ink stampings can be manufactured much more easily and economically. Substantial labor savings are achieved, and a single coat of paint also achieves substantial material savings.

Figure 3:
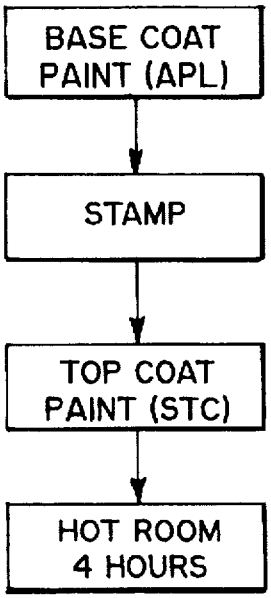
FIG. 3 PRIOR ART
FIG. 3 is a flow chart illustrating a conventional prior art method of processing golf balls.
Figure 4:
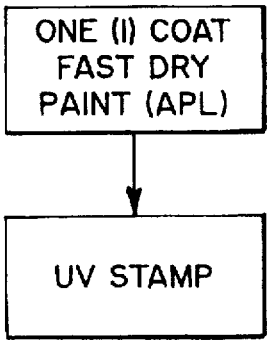
FIG. 4 is a flow chart illustrating the inventive method of processing golf balls.

The advantages and economics of using a single coat of paint and/or UV curable ink can be demonstrated by comparing a conventional prior art manufacturing process illustrated in FIG. 3 with the inventive process illustrated in FIG. 4.

Prior Art Ball Finishing Process (FIG. 3)

BASE COAT PAINT (Automatic Paint Line or APL)—In this operation, balls are painted with a water based coat of primer paint. The purpose of this operation is to prepare the balls for stamping and to add the optic color. The balls are automatically loaded from gondolas onto paint spindles. The balls then pass in front of paint guns as the spindles rotate the balls to insure all surfaces of the ball are painted. The balls then travel through a drying (or curing) oven where the paint is allowed to dry. The balls exit the oven and are knocked off into a gondola.

STAMP—In the stamping process, the production logos and/or trademarks and identifying numbers are printed on the balls. The balls are loaded into hoppers from the gondolas and are fed onto a loading conveyor. The logos and numbers are printed by silicone pad transfer using thermoplastic type inks. The balls are then offloaded onto trays and racks.

TOP COAT PAINT (Solvent Top Coat or STC)—In this operation, balls are painted with a solvent based coat of paint. The purpose of this operation is to protect the stamp and to improve the cosmetic appearance of the ball. The balls are manually loaded from the racks and trays onto paint spindles. The balls then pass in front of the paint guns as the spindles rotate the balls to insure all surfaces of the ball are painted. The balls are then manually removed from the spindles and returned to the trays and racks. The balls are then placed into a curing room (110deg. F.) for four hours where the paint is allowed to dry.

New Ball Finishing Process (FIG. 4)

ONE COAT FAST DRY PAINT (Automatic Paint Line or APL)—In this operation, balls are painted with a one coat fast dry paint. The purpose of this operation is to add the optic color and to improve the cosmetic appearance of the balls. The balls are automatically loaded from gondolas onto paint spindles. The balls then pass in front of the paint guns as the spindles rotate the balls to insure all surfaces of the ball are painted. The balls then travel through a drying (or curing) oven where the paint is allowed to dry. The balls exit the oven and are knocked off into a gondola.

UV STAMP—In the stamping process, the production logos and numbers are printed on the balls. The balls are loaded into hoppers from the gondolas and are fed onto a loading conveyor. The logos are printed by silicone pad transfer using UV curable type inks. The ink is cured and the balls are then offloaded into gondolas.

Details of the Prior Art Ball Finishing Process

The painting process involves the precise application of paint to the golf ball. The actual process equipment is a spray painting booth.

Traditionally, two or more coats of paint are applied to the ball. The first coat of paint is a water based primer. This primer prepares the balls for stamping and adds the optic color for cosmetic purposes. The optical brightener is at a level of about 2% by weight of the solids content of the primer. The primer is applied in the APL area in a setup where the balls are automatically loaded from gondolas onto spindles. The ball and spindle pass in front of the paint guns as the spindle rotates to insure all surfaces of the ball are painted. Approximately 120 milligrams of wet paint are applied to each ball. The balls then travel through a drying (or curing) oven where the paint is allowed to dry. The drying process takes about 4 minutes. After the balls exit the oven, they are off loaded into gondolas. The balls are then typically sent through the stamping process.

After stamping, the top coat of paint is applied to the ball. The actual application of the paint is very similar to the primer coat of paint. However, there are. some major differences in the process. The balls must be handled manually due to the nature of the stamping ink and its lack of durability. The balls are loaded manually onto spindles instead of automatically and they are manually removed from the spindles so they can be placed into a curing room for four hours at a temperature of 110 deg. F. to allow the paint to dry or cure. The weight of paint applied is approximately 200 milligrams. This coat of paint provides protection for the stamp as well as improving the cosmetic appearance of the ball. This paint is typically a solvent based two component urethane paint with a solids content of about 38% by weight.

Details of New Ball Finishing Process

The new painting process uses one coat of paint in place of the two or more. This one coat of paint combines the features of the two coats it replaces. It provides the color, via optical brightener, and the cosmetic appearance. It would also provide protection for the stamp if the stamp is applied to the ball first. This one coat of paint also eliminates the manual handling associated with applying the top coat of paint as it is applied using our automatic paint line, thus providing significant savings.

The one coat of paint is applied in a setup where the balls are automatically loaded from gondolas onto spindles. The ball and spindle pass in front of the paint guns as the spindle rotates to insure all surfaces of the ball are painted. Approximately 200 milligrams of wet paint are applied to each ball. The balls then travel through a drying (or curing) oven where the paint is allowed to dry. The drying process takes about 4 minutes. After the balls exit the oven, they are knocked off the spindles into a gondola. The balls are then typically sent through the stamping process, but could also have been stamped prior to painting. This painting setup is identical to the conventional prior art process used to apply the water based primer paint.

Details of the Stamping Process

The stamping process utilizes a pad printing process to apply lettering, symbols, or numbers to the golf ball as required. Printing involves the precise application of ink to the ball and may be either single or multi-color. The pad printing process involves the transfer of ink from a cliche, or image carrier, to the substrate, or golf ball, via a flexible (usually silicone) pad.

Traditionally, the stamping ink is air dried and thermoplastic in nature. It is applied on top of a layer of primer paint and then an additional layer of paint is applied on top of the ink. The nature of this ink forces the manufacturer to handle each ball carefully to avoid damaging the printed area.

The new stamping process uses a durable ultraviolet (UV) curable ink. The ink can be applied directly to the ball using no primer paint, on top of a layer of primer paint, or even on top of the outer layer of paint, which may be a single layer of paint. Because of the durable nature of the UV ink, balls can be handled in bulk in place of the careful manual handling required with traditional inks.

This new process offers a high level of stamp durability immediately after the ink is cured. This allows balls to be handled in bulk containers after printing, which can then be moved directly to paint lines or packaging lines. This eliminates the practice of an operator manually loading each printed ball to paint spindles or trays in order to avoid damaging the printed area.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. A golf ball consisting of a core, a cover, and a single coat of solvent-based transparent paint in contact with the cover, the coat of paint being the outermost coat of the golf ball and including an optical brightener, and indicia on the single coat of paint, the indicia comprising UV cured ink, which is chemically bonded to the coat of paint, the indicia being free of any protective coating.

* * * * *